US007348555B2

(12) United States Patent
Usami et al.

(10) Patent No.: US 7,348,555 B2
(45) **Date of Patent: *Mar. 25, 2008**

(54) APPARATUS AND METHOD FOR IRRADIATING ELECTRON BEAM

(75) Inventors: Mamoru Usami, Tokyo (JP); Kazushi Tanaka, Tokyo (JP); Yukio Kaneko, Tokyo (JP); Naoyuki Echigo, Tokyo (JP); Hiroshi Tominaga, Tokyo (JP); Akihiko Kizaki, Tokyo (JP); Kunihiko Ozaki, Tokyo (JP)

(73) Assignee: TDK Corporation, Tokyo (JP)

( * ) Notice: Subject to any disclaimer, the term of this patent is extended or adjusted under 35 U.S.C. 154(b) by 66 days.

This patent is subject to a terminal disclaimer.

(21) Appl. No.: 11/029,810

(22) Filed: Jan. 4, 2005

(65) Prior Publication Data

US 2005/0173654 A1 Aug. 11, 2005

(30) Foreign Application Priority Data

Jan. 7, 2004 (JP) ..... 2004-002232

(51) Int. Cl.
*H01J 49/32* (2006.01)

(52) U.S. Cl. ..... 250/295; 250/492.1; 250/492.3; 422/22

(58) Field of Classification Search ..... 250/295
See application file for complete search history.

(56) References Cited

U.S. PATENT DOCUMENTS 5,414,267 A 5/1995 Wakaopulos
2006/0011133 A1* 1/2006 Nishibayashi ..... 118/630

FOREIGN PATENT DOCUMENTS

| | | |
|---|---|---|
| JP | 2-208325 A | 8/1990 |
| JP | 7-019340 A | 1/1995 |
| JP | 9-101400 A | 4/1997 |

OTHER PUBLICATIONS

Related U.S. Appl. No. 11/029,815, filed Jan. 4, 2005; Inventor: Mamoru Usami et al.; Entitled: Apparatus and Method for Irradiating Electron Beam.

* cited by examiner

*Primary Examiner*—Nikita Wells
*Assistant Examiner*—Phillip A Johnston
(74) *Attorney, Agent, or Firm*—Frishauf, Holtz, Goodman & Chick, P.C.

(57) ABSTRACT

An electron beam irradiation apparatus includes a turn-transfer mechanism; a turn irradiation chamber; an electron beam irradiation section; a replacement room configured to bring a target into and out of the turn irradiation chamber; an outer irradiation target holding table configured to form a part of the replacement room, and including an X-ray shielding mechanism, an airtightness maintaining mechanism, a target holding mechanism; an inner irradiation target holding table configured to form a part of the replacement room, and including an X-ray shielding mechanism, an airtightness maintaining mechanism, and a target holding mechanism, the inner irradiation target holding table being supported by the turn-transfer mechanism; a turning mechanism configured to drive the turn-transfer mechanism; and an elevator mechanism configured to move the turn-transfer mechanism, which supports the inner irradiation target holding table, up and down.

23 Claims, 8 Drawing Sheets

APPARATUS AND METHOD FOR IRRADIATING ELECTRON BEAM

BACKGROUND OF THE INVENTION

1. Field of the Invention

The present invention relates to an electron beam irradiation apparatus and irradiation method for performing electron beam irradiation so as to carry out a process, such as cross-linking or curing of a coating formed of, e.g., a printing ink, paint, an adhesive, a pressure sensitive adhesive, or a hard protective film, which is formed on a target object, such as a display unit, optical disk, glass lens, or ID card; or a process, such as sterilization or modification of an object.

2. Description of the Related Art

Many techniques using electron beam irradiation have been proposed as means for carrying out a process, such as cross-linking, curing, or modification of a coating formed of, e.g., a paint, an adhesive, a pressure sensitive adhesive, or a hard protective film, which is disposed on a substrate (for example, Jpn. Pat. Appln. KOKAI Publication No. 2-208325). When a process using electron beam irradiation takes place, electrons are accelerated by an acceleration voltage within a vacuum, and an irradiation target placed within a vacuum or inert gas atmosphere is irradiated with the accelerated electrons.

Processing techniques using electron beam irradiation have many advantages, such that an irradiation target is far less heated, no organic solvent needs to be used, and no curing initiator is necessary.

However, the technique disclosed in the publication described above needs an electron beam irradiation tube of a drum type, and problems thereby arise, as follows. Specifically, such a large electron irradiation tube is operated at a high acceleration voltage, which requires a strict X-ray shield. Further, a large amount of inert gas, such as nitrogen gas, needs to be supplied, so that the oxygen ratio in the atmosphere around an irradiation target is reduced to prevent inhibition of curing by oxygen. As a consequence, the conventional electron beam irradiation apparatus becomes very large in its own size with a large weight. In addition, an electron beam at a high acceleration voltage may cause deterioration, such as yellowing, of some substrates.

As a technique for preventing an increase in the size of the entire apparatus, Jpn. Pat. Appln. KOKAI Publication No. 9-101400 discloses an arrangement in which a transfer system for an irradiation target is modified. In this arrangement, however, since an apparatus having a load-lock chamber is further enveloped within a shield chamber made of lead, the entire apparatus inevitably ends up being still large.

Jpn. Pat. Appln. KOKAI Publication No. 7-019340 discloses a vacuum chamber for ion beam irradiation arranged for the purpose of decreasing the size and contamination, which can actually realize a compact vacuum chamber. This technique, however, is not directed to electron beam irradiation, and thus includes nothing about an X-ray shield. Accordingly, this technique does not solve the problems described above in relation to electron beam irradiation apparatuses, to which the present invention is directed.

U.S. Pat. No. 5,414,267 discloses a technique for downsizing an electron beam irradiation tube and decreasing the acceleration voltage, in which the material of an electron beam irradiation window is modified to realize a high transmittancy for an electron beam even at a low acceleration voltage. Since this technique can thus downsize an electron beam irradiation tube and decrease the acceleration voltage, the amount of X-rays generated from the electron beam irradiation tube is smaller, which allows use of stainless steel in place of lead as an X-ray shield material. Further, since the acceleration voltage to draw out an electron beam is low, a substrate is less affected.

However, since this technique still needs to use an X-ray shield, an inert gas, and a vacuum, the entire apparatus inevitably ends up being large. Further, this publication only discloses a complicated and large apparatus structure including a transfer mechanism prepared for an irradiation target, such as a sheet or cable. Accordingly, as regards an apparatus for performing electron beam irradiation on a number of single articles, this publication does not suggest anything about downsizing or simplifying such an apparatus, or reducing the cycle time for processing an irradiation target.

BRIEF SUMMARY OF THE INVENTION

An object of the present invention is to provide an electron beam irradiation apparatus, which is compact and simple, uses a smaller amount of inert gas, and has a shorter cycle time for processing an irradiation target.

Another object of the present invention is to provide an electron beam irradiation method, which uses such an electron beam irradiation apparatus to realize electron beam irradiation with a shorter cycle time for processing an irradiation target.

According to a first aspect of the present invention, there is provided with an electron beam irradiation apparatus comprising: a turn-transfer mechanism configured to turn-transfer an irradiation target; a turn irradiation chamber in which the turn-transfer mechanism is disposed; an electron beam irradiation section configured to irradiate the irradiation target with an electron beam during turn-transfer of the irradiation target; a replacement room disposed at a part of the turn irradiation chamber, and configured to bring the irradiation target into and out of the turn irradiation chamber; an outer irradiation target holding table disposed outside the turn irradiation chamber, configured to form a part of the replacement room, and including an X-ray shielding mechanism, an airtightness maintaining mechanism, and an irradiation target holding mechanism; an inner irradiation target holding table disposed inside the turn irradiation chamber, configured to form a part of the replacement room, and including an X-ray shielding mechanism, an airtightness maintaining mechanism, and an irradiation target holding mechanism, the inner irradiation target holding table being supported by the turn-transfer mechanism; a turning mechanism configured to drive the turn-transfer mechanism in a transfer direction; and an elevator mechanism configured to move the turn-transfer mechanism, which supports the inner irradiation target holding table, up and down.

According to a second aspect of the present invention, there is provided with an electron beam irradiation method for irradiating an irradiation target with an electron beam under an inert gas atmosphere while turn-transferring the irradiation target within a turn irradiation chamber, using an electron beam irradiation apparatus, which comprises a turn-transfer mechanism configured to turn-transfer the irradiation target; the turn irradiation chamber in which the turn-transfer mechanism is disposed; an electron beam irradiation section configured to irradiate the irradiation target with an electron beam during turn-transfer of the irradiation target; a replacement room disposed at a part of the turn irradiation chamber, and configured to bring the irradiation target into and out of the turn irradiation chamber; an outer irradiation target holding table disposed outside the turn irradiation chamber, configured to form a part of the replacement room, and including an X-ray shielding mechanism, an airtightness maintaining mechanism, and an irradiation target holding mechanism; and an inner irradiation target holding table disposed inside the turn irradiation chamber, configured to form a part of the replacement room, and including an X-ray shielding mechanism, an airtightness maintaining mechanism, and an irradiation target holding mechanism, the inner irradiation target holding table being supported by the turn-transfer mechanism, the method comprising: transferring the irradiation target between the inner irradiation target holding table and the outer irradiation target holding table, which respectively form parts of the replacement room, to bring the irradiation target into and out of the turn irradiation chamber; driving the inner irradiation target holding table for movement up and down and turn-transfer by the turn-transfer mechanism; and irradiating the irradiation target with an electron beam while the inner irradiation target holding table passes through the electron beam irradiation section during the turn-transfer.

According to the present invention, when an irradiation target is brought into and out of the electron beam irradiation section of the turn irradiation chamber, the outer irradiation target holding table and the inner irradiation target holding table form the replacement room working as a load-lock door. This load-lock door realizes an X-ray shield function and an airtightness maintaining function for the turn irradiation chamber. Further, the tables also work as transfer tables within the turn irradiation chamber. As a consequence, the electron beam irradiation apparatus can be structured to be simple and lightweight, and the entire apparatus becomes compact. Further, the amount of consumption of inert gas can be reduced, for filling the turn irradiation chamber to prevent curing inhibition by oxygen on an irradiation target. This can shorten the time necessary for displacement with an inert gas, and thus can realize a cycle time shortened by that much.

When the irradiation target holding table is turned for replacement of irradiation targets, electron beam irradiation on an irradiation target is performed during turn-transfer. In this case, the total time necessary for performing an electron beam irradiation process on an irradiation target within the turn irradiation chamber is essentially the sum of an irradiation target replacement time at the replacement room and a turn-transfer time within the turn irradiation chamber. As a consequence, the total time is reduced by the extent corresponding to the irradiation time, thereby further reducing the cycle time.

Further, since the amount of consumption of inert gas, such as nitrogen gas, is remarkably reduced, the running cost of the electron beam irradiation apparatus can be lower, thereby reducing the process cost of irradiation targets.

Furthermore, the outer irradiation target holding table, which is used for transferring an irradiation target to and from the inner irradiation target holding table, includes a load-lock mechanism and an X-ray shielding mechanism, which enhance the advantages described above of the present invention.

In addition, where the electron beam irradiation section is formed of vacuum-tube type irradiation tubes, which are used at an acceleration voltage of 80 kV or less, the apparatus can be more compact. In this case, since the acceleration voltage is low, the X-ray shield does not necessary have to be made of lead, which is toxic, and an irradiation target substrate is less damaged or deteriorated.

Further, where the apparatus is provided with a rotation mechanism for rotating an irradiation target, or a shutter mask, the absorption dose can be more uniform. In this case, the number of vacuum-tube type irradiation tubes can be reduced, thereby reducing the cost of the electron beam irradiation apparatus, and the running cost in relation to the operating life of the irradiation tubes.

DETAILED DESCRIPTION OF THE INVENTION

A detailed description will be given of embodiments of the present invention, with reference to drawings.

Figure 1:
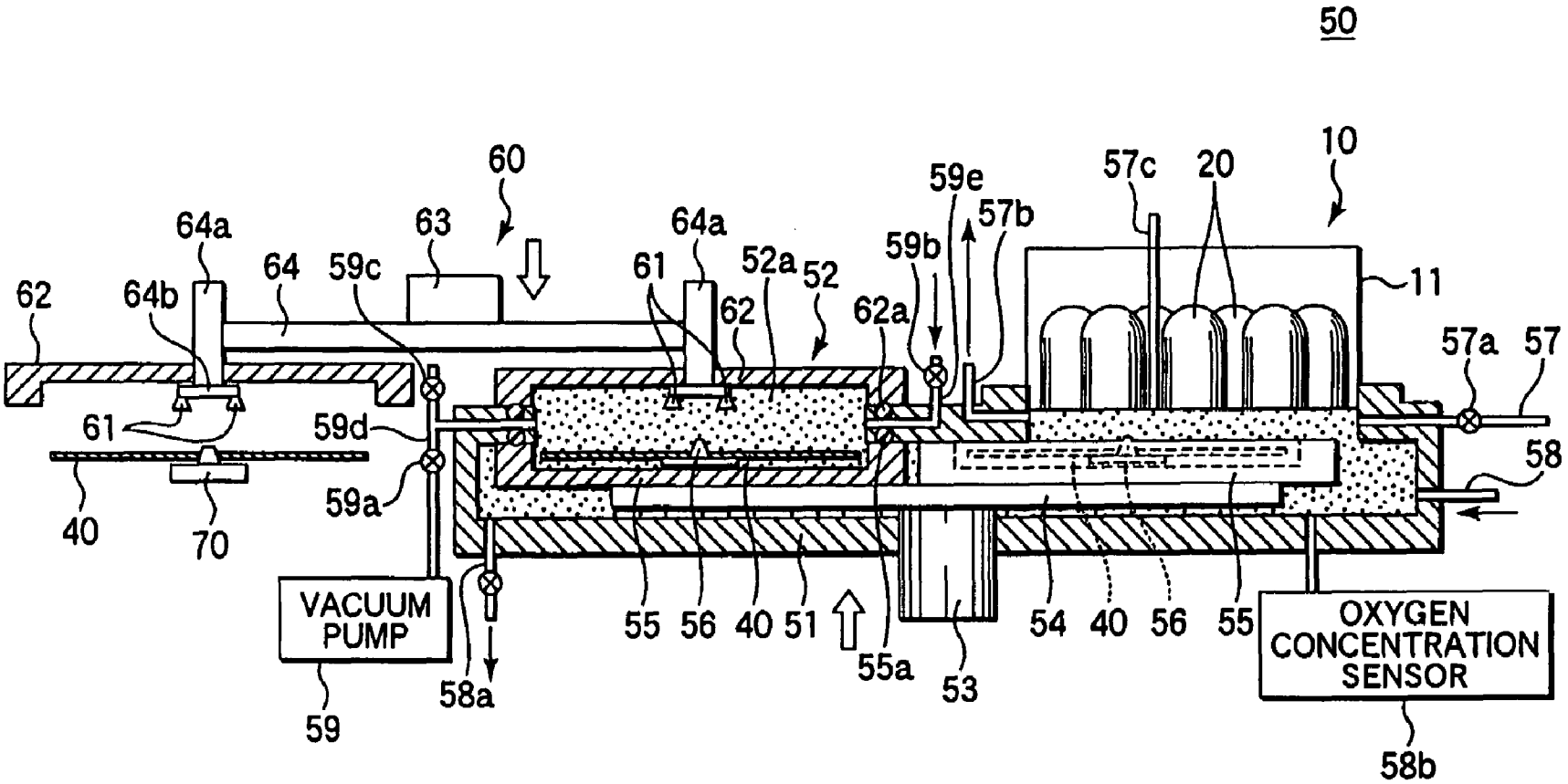
FIG. 1 is a sectional view showing a schematic structure of an electron beam irradiation apparatus according to an embodiment of the present invention.
Figure 2:
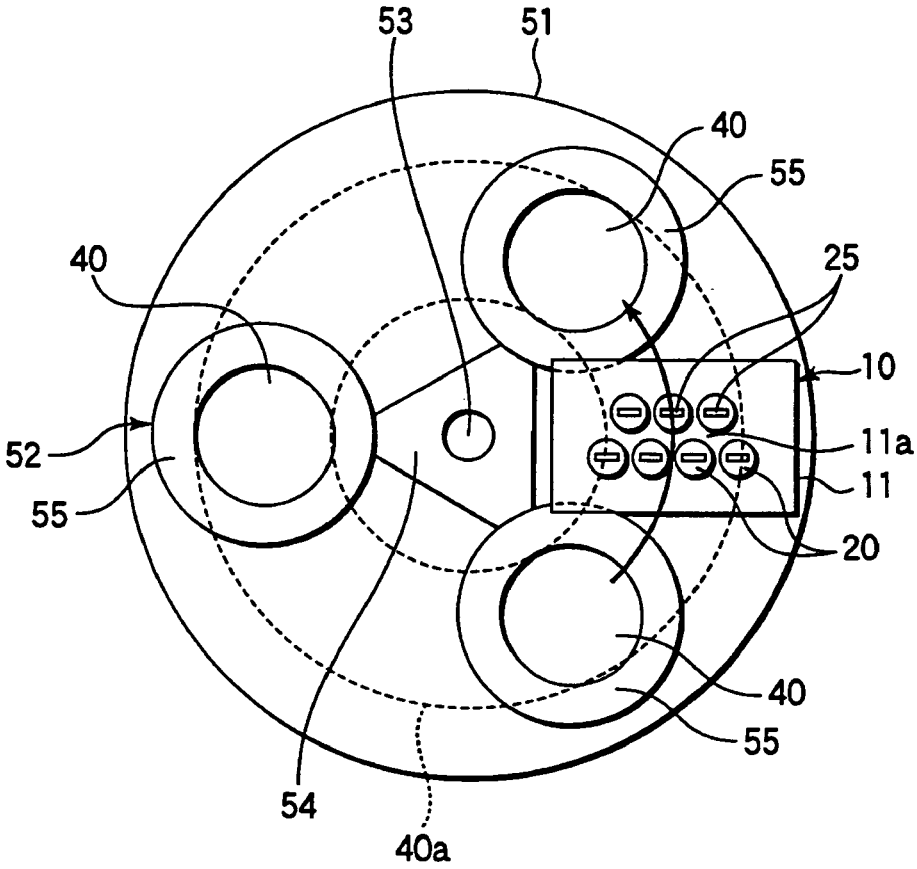
FIG. 2 is a plan view showing a schematic structure of the electron beam irradiation apparatus according to an embodiment of the present invention.

FIG. 1 is a sectional view schematically showing an electron beam irradiation apparatus according to an embodiment of the present invention, and FIG. 2 is a plan view thereof.

This electron beam irradiation apparatus 50 includes a chamber 51, which is provided with an electron beam irradiation section 10 and a replacement room section 52 disposed at its ceiling. The chamber 51 accommodates a plurality of inner transfer turn trays 55 each for supporting an irradiation target 40, and a revolution arm portion 54 supporting these inner transfer turn trays 55. Each of the inner transfer turn trays 55 has a recess opened upward, with an irradiation target support 56 provided at the center for detachably supporting the irradiation target 40. As illustrated in FIG. 2, this embodiment has three inner transfer turn trays 55 disposed at intervals to divide the entire circumference equally into three portions.

The irradiation target 40 is a plate-like object having a surface covered with a resin layer formed of, e.g., a print ink, a paint, an adhesive, or a protective film material, which has been applied by, e.g., a spin coating, coating, or spraying method.

The chamber 51 is provided with a revolution shaft 53 at the center to turn (revolve) the inner transfer turn trays 55 each supporting an irradiation target 40 within the chamber 51, by the revolution arm portion 54, such that the trays 55 pass through the electron beam irradiation section 10 and replacement room section 52.

This revolution shaft 53 is movable up and down by an elevator mechanism (not shown), so that the inner transfer turn trays 55 supported by the revolution arm portion 54 can be moved up and down within the chamber 51.

The outer wall of the chamber 51 is provided with an inert gas inlet 58, a gas outlet 58*a*, and an oxygen concentration sensor 58*b*. An apparatus control section (not shown) controls the flow rate of an inert gas, such as nitrogen gas, to adjust the oxygen concentration within the chamber 51 measured by the oxygen concentration sensor 58*b* to be equal to or less than a predetermined value.

The replacement room section 52 of the chamber 51 has an opening 52*a* provided with a shielding seal portion 55*a*, at a position corresponding to the periphery of each inner transfer turn tray 55. In order to bring one of the inner transfer turn trays 55 into close contact with the opening 52*a*, the inner transfer turn trays 55 are turned by the revolution shaft 53 to position this tray directly below the opening 52*a*, and they are then moved up. At this time, the close contact portion of the opening 52*a* with the inner transfer turn tray 55 becomes airtight at a high level, thereby realizing an excellent shielding characteristic against X-rays generated as described later.

An irradiation target transfer device 60 and an irradiation target delivery portion 70 are disposed outside the chamber 51. This irradiation target transfer device 60 includes an outer transfer arm 64, a plurality of outer transfer turn trays 62 connected to the opposite ends of the outer transfer arm 64 each through a holding arm 64*a*, and an outer transfer turn shaft 63 for turning the outer transfer arm 64 and moving it up and down. The outer transfer arm 64 has a span connecting the replacement room section 52 and the irradiation target delivery portion 70 to each other. The holding arms 64*a* are disposed at the opposite ends of the outer transfer arm 64 perpendicularly to the arm 64. The outer transfer turn trays 62 are respectively attached to the bottom ends of the holding arms 64*a*. Each of the outer transfer turn trays 62 has a recess opened downward, and is supported to be movable up and down relative to the corresponding holding arm 64*a*.

Although not specifically shown, the portion of each outer transfer turn tray 62 where the holding arm 64*a* penetrates is also provided with a shielding seal structure, so that this portion is kept airtight and provided with an X-ray shield.

It should be noted that the term "turn" used for an irradiation target in this specification means that it is turned while shifting stop positions, such that it is turned by a predetermined amount in one direction or the opposite direction, and is then stopped there. Although the irradiation target is moved about a certain point used as the center, this differs from rotation in which the target is continuously rotated in one direction (or the opposite direction).

The bottom end of each holding arm 64*a*, which penetrates the center of the outer transfer turn tray 62, is provided with a flange 64*b* for preventing the outer transfer turn tray 62 from becoming dislodged, and holding portions 61 for detachably holding an irradiation target 40. This arrangement is used to perform a replacement operation of the irradiation target 40 while holding it, between the irradiation target delivery portion 70 and the inner transfer turn tray 55 disposed in the replacement room section 52. Each holding portion 61 is formed of, e.g., a mechanical chuck or vacuum chuck.

A shielding seal portion 62*a* is disposed at the periphery of the opening 52*a* of the replacement room section 52, so that, when each outer transfer turn tray 62 is brought into close contact with the opening 52*a* by the outer transfer arm 64 moved up and down, this portion is kept airtight and provided with an X-ray shield.

Specifically, the replacement room section 52 is formed and functions as a load-lock chamber, when the inner transfer turn tray 55 disposed inside the chamber 51 and the outer transfer turn tray 62 disposed outside the chamber 51 engage to airtightly close the opening 52*a*. This arrangement allows an irradiation target 40 to be transferred in and out, while preventing X-ray leakage, without damaging the inert gas atmosphere within the chamber 51.

The opening 52*a* of the replacement room section 52 is provided with a vacuum exhaust line 59*d* connected to a vacuum pump 59, for exhausting the interior of the replacement room section 52. The opening 52*a* is also provided with a displacement gas supply line 59*e* connected to an inert gas supply source (not shown), for supplying an inert gas, such as nitrogen gas, into the replacement room section 52.

The vacuum exhaust line 59*d* divided into a branch line connected to the vacuum pump 59, and a branch line opened to atmosphere, which are provided with an exhaust control valve 59*a* and an atmosphere ventilation valve 59*c*, respectively. The displacement gas supply line 59*e* is provided with a displacement gas supply control valve 59*b*, to control supply of an inert gas into the replacement room section 52.

The chamber 51, inner transfer turn trays 55, and outer transfer turn trays 62, described above, are made of a metal material with a thickness necessary for blocking X-rays, which are generated during electron beam irradiation, as described later. Each of the shielding seal portion 55*a* and shielding seal portion 62*a*, which are respectively disposed at the portions of the chamber 51 to be in close contact with the inner transfer turn trays 55 and outer transfer turn trays 62, is provided with a step portion (not shown) to prevent X-rays from directly leaking even if there is a small gap, i.e., to allow only reflected X-rays to leak outside. Accordingly, X-ray shielding mechanisms are respectively constituted by the metal material with a thickness necessary for blocking X-rays and the step portion of the shielding seal portion 55*a*, and the metal material and the step portion of the shielding seal portion 62*a*. Specifically, in general, it is safe if the shielding seal portion 55*a* and shielding seal portion 62*a* have a shape to reflect, two times or more, X-rays emitted from an X-ray generation source, because the leakage X-ray quantity is remarkably reduced to a safe X-ray level present under ordinary living conditions.

On the other hand, the electron beam irradiation section 10 according to this embodiment includes a shield box 11 for blocking X-rays, which is airtightly connected to the chamber 51, and electron beam irradiation sources contained in the shield box 11 and formed of a plurality of vacuum-tube type irradiation tubes 20.

The mount portion of the chamber 51 for the shield box 11 is connected to an inert gas feed line 57 and an inert gas exhaust line 57*b*, for flowing a cooling inert gas through the bottom ends of the vacuum-tube type irradiation tubes 20. The inert gas feed line 57 is provided with an inert gas feed control valve 57*a* for controlling the flow rate of the inert gas supplied for cooling. An apparatus control section (not shown) controls the supply, stop, and flow rate of the inert gas in accordance with the temperature detected by a temperature sensor 57*c* at the bottom of the vacuum-tube type irradiation tubes 20, so that the vacuum-tube type irradiation tubes 20 are effectively cooled by a minimum amount of inert gas thus required.

Figure 3:
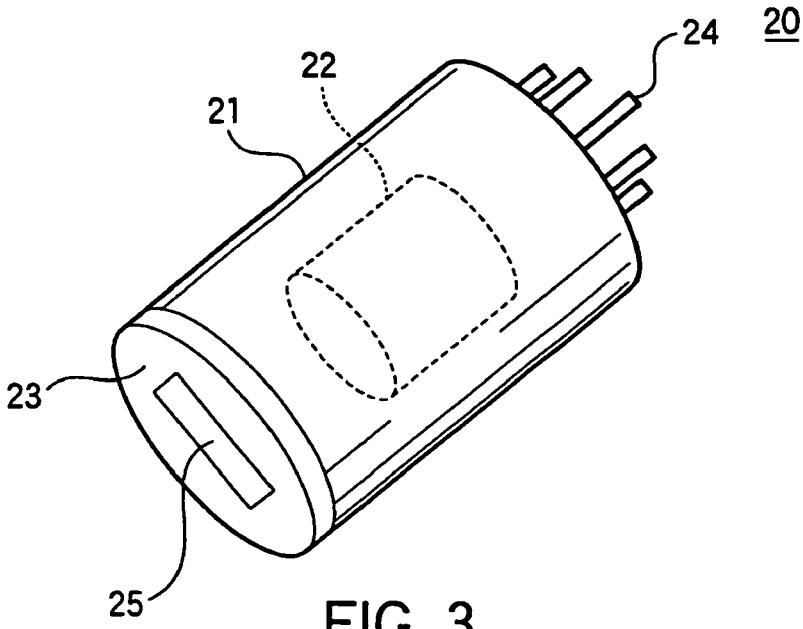
FIG. 3 is a perspective view showing an electron beam irradiation tube used in the electron beam irradiation apparatus according to an embodiment of the present invention.

Each of the electron beam irradiation sources disposed in the electron beam irradiation section 10 is preferably of a vacuum-tube type, as disclosed in U.S. Pat. No. 5,414,267 described above. Such a vacuum-tube type electron beam irradiation source employs an electron beam generating portion formed of a vacuum-tube type irradiation tube 20, as shown in FIG. 3. The vacuum-tube type irradiation tube 20 includes a cylindrical vacuum tube 21 made of glass or ceramic; an electron beam generating portion 22 disposed in the vacuum tube 21 serving to draw out electrons emitted from a cathode and accelerate the electrons so as to generate an electron beam; an electron beam emitting portion 23 disposed at an end of the vacuum tube 21 to emit the electron beam; and an electricity supply pin portion 24 to which electricity is supplied from a power supply (not shown). The electron beam emitting portion 23 is provided with a thin film radiation window 25. The radiation window 25 of the electron beam emitting portion 23 has a shape like a slit and does not allow any gas to pass therethrough, but allows the electron beam to pass therethrough.

The vacuum-tube type irradiation tubes 20 are arrayed at the bottom opening of the shield box 11, while their electron beam emitting portions 23 are directed downward, so that they irradiate an irradiation target with electron beams emitted through the radiation windows 25, when the target passes through the electron beam irradiation section 10.

Figure 4:
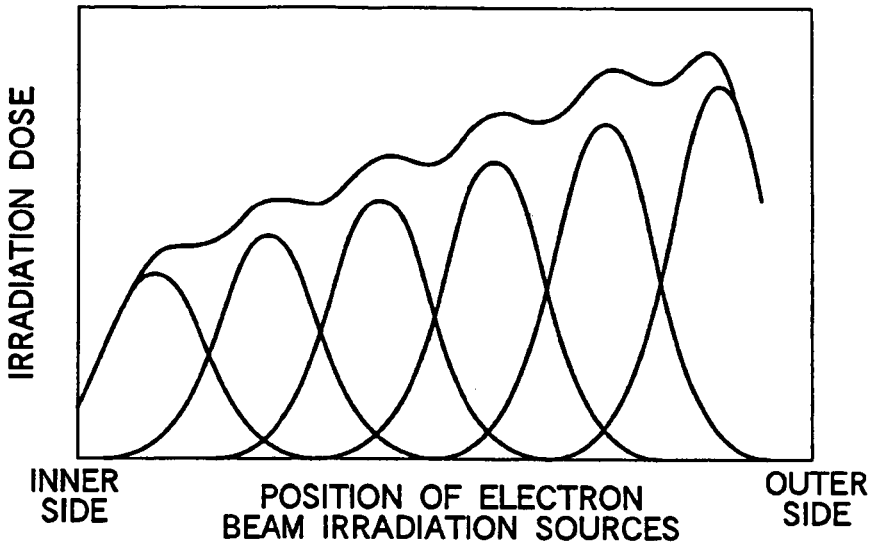
FIG. 4 is a view showing a modification of the irradiation dose distribution of a plurality of vacuum-type irradiation tubes used in the electron beam irradiation apparatus according to an embodiment of the present invention.

As shown in FIG. 2, the vacuum-tube type irradiation tubes 20 are arrayed in a plurality of lines that extend across a doughnut-like passage area 40*a* for an irradiation target 40 placed on and moved by each inner transfer turn tray 55. The vacuum-tube type irradiation tubes 20 are arranged such that their radiation windows 25 are arrayed across the passage area 40*a* with no gaps therebetween, when observed in the transfer direction of the irradiation target 40. With this arrangement, the irradiation target 40 can be irradiated with electron beams all over, when it passes through the electron beam irradiation section 10.

Where an irradiation target 40 is revolved during electron beam irradiation, as in this embodiment, the inner and outer sides of the doughnut-like passage area 40*a* have different peripheral velocities in passage. Accordingly, if the irradiation is simply performed at a uniform radiation dosage in the width direction, the dose amount (irradiation dose) becomes excessive (or insufficient) at the inner (or outer) side. For this reason, as illustrated in FIG. 4, the irradiation dose distribution of the vacuum-tube type irradiation tubes 20 arrayed across the passage area 40*a* is controlled, such that the irradiation dose is gradually higher as their positions are shifted from the inner side to the outer side of the passage area 40*a*. With this arrangement, the irradiation target 40 can be irradiated with electron beams uniformly all over, when the irradiation target 40 passes through the electron beam irradiation section 10.

Also in this embodiment, as shown in FIG. 2, the position of the electron beam irradiation section 10 is set to be approximately intermediate between the stop positions of the inner transfer turn trays 55, which are intermittently turned to transfer an irradiation target 40 into the replacement room section 52. Electron beam irradiation is performed on an irradiation target 40 while the irradiation target 40 mounted on the corresponding inner transfer turn tray 55 is shifted from one stop position to the next stop position.

A vacuum-tube type electron beam irradiation source, such as the vacuum-tube type irradiation tube 20 described above, is fundamentally different from conventional drum type electron beam irradiation sources. Conventional drum type electron beam irradiation sources are of the type in which electron beam irradiation is performed while the interior of a drum is kept vacuum-exhausted. Conventional drum type electron beam generation sources are large-sized, and are difficult for use in a transfer line, as described above, and also difficult to adjust in terms of the electron current, acceleration voltage, and distance, as described above. On the other hand, the electron beam generation source including an irradiation tube of this type is compact, and is easy for use in an inline manner. Further, an electron beam is effectively drawn out at a lower acceleration voltage, with good controllability, so the adjustment described above can be easily performed. In addition, the underlying layer below a target layer for electron beam irradiation is less affected. Since the acceleration voltage is low, radiation rays, such as X-rays, are less generated, whereby the shielding devices for blocking the radiation rays can be compact or reduced. Furthermore, according to this vacuum-tube type electron beam irradiation source, the vacuum-tube type irradiation tubes 20 can be controlled independently of each other, thereby facilitating their inclination, gradient, or adjustment, as described later.

In general, electron beam irradiation is performed under an inert gas atmosphere of, e.g., nitrogen gas. On the other hand, according to this vacuum-tube type electron beam irradiation source, irradiation may be performed under air or an atmosphere containing an inert gas, which is close to air, depending on the conditions.

Next, an explanation will be given of an operation of the electron beam irradiation apparatus according to this embodiment with the arrangement described above.

As described later, the electron beam irradiation apparatus according to this embodiment continuously repeats replacement and electron beam irradiation for irradiation targets 40. However, an explanation will start from the state shown in FIG. 1, for the sake of convenience.

The interior of the chamber 51 is filled with an inert gas, which flows in from the inert gas inlet 58 and flows out from gas outlet 58*a*. The oxygen concentration therein detected by the oxygen concentration sensor 58*b* is controlled to be equal to or less than a predetermined value.

As shown in FIG. 1, from the irradiation target transfer device 60, the outer periphery of one of the outer transfer turn trays 62 comes into airtightly close contact with the outer periphery of the opening 52*a* through the shielding seal portion 62*a*. On the other hand, in the chamber 51, one of the inner transfer turn trays 55 is positioned relative to the opening 52*a* of the replacement room section 52 by turning of the revolution shaft 53 and is moved up. By doing so, the inner transfer turn tray 55, which supports an irradiation target 40 having already been subjected to irradiation, comes into close contact with the opening 52*a* through the shielding seal portion 55*a*, thereby making the replacement room section 52 in an airtightly closed state.

Figure 5:
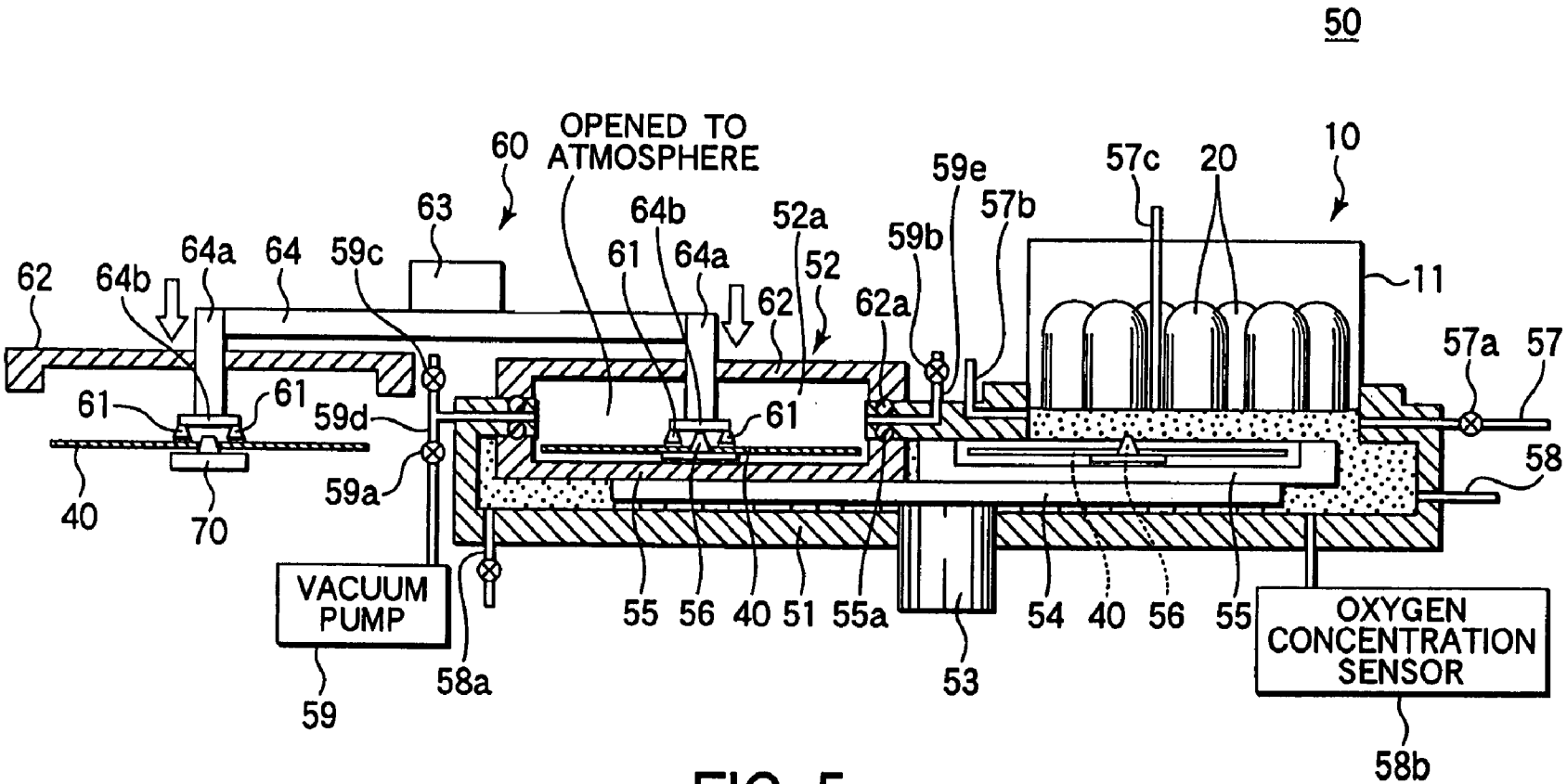
FIGS. 5 to 8 are sectional views each showing a schematic structure of the electron beam irradiation apparatus according to an embodiment of the present invention, for explaining an operation thereof.

Then, as shown in FIG. 5, after the atmosphere ventilation valve 59*c* is opened to connect the replacement room section 52 to atmosphere, the holding arms 64*a* provided on the outer transfer arm 64 of the irradiation target transfer device 60 are moved down, and the irradiation target 40 placed within the replacement room section 52 is held by vacuum-chucking of the holding portions 61 of one of the arms 64*a*. At the same time, an irradiation target 40, which has not yet been subjected to irradiation and is placed on the irradiation target delivery portion 70 outside the chamber 51, is held by vacuum-chucking of the holding portions 61 of the other of the holding arms 64*a*.

Figure 6:
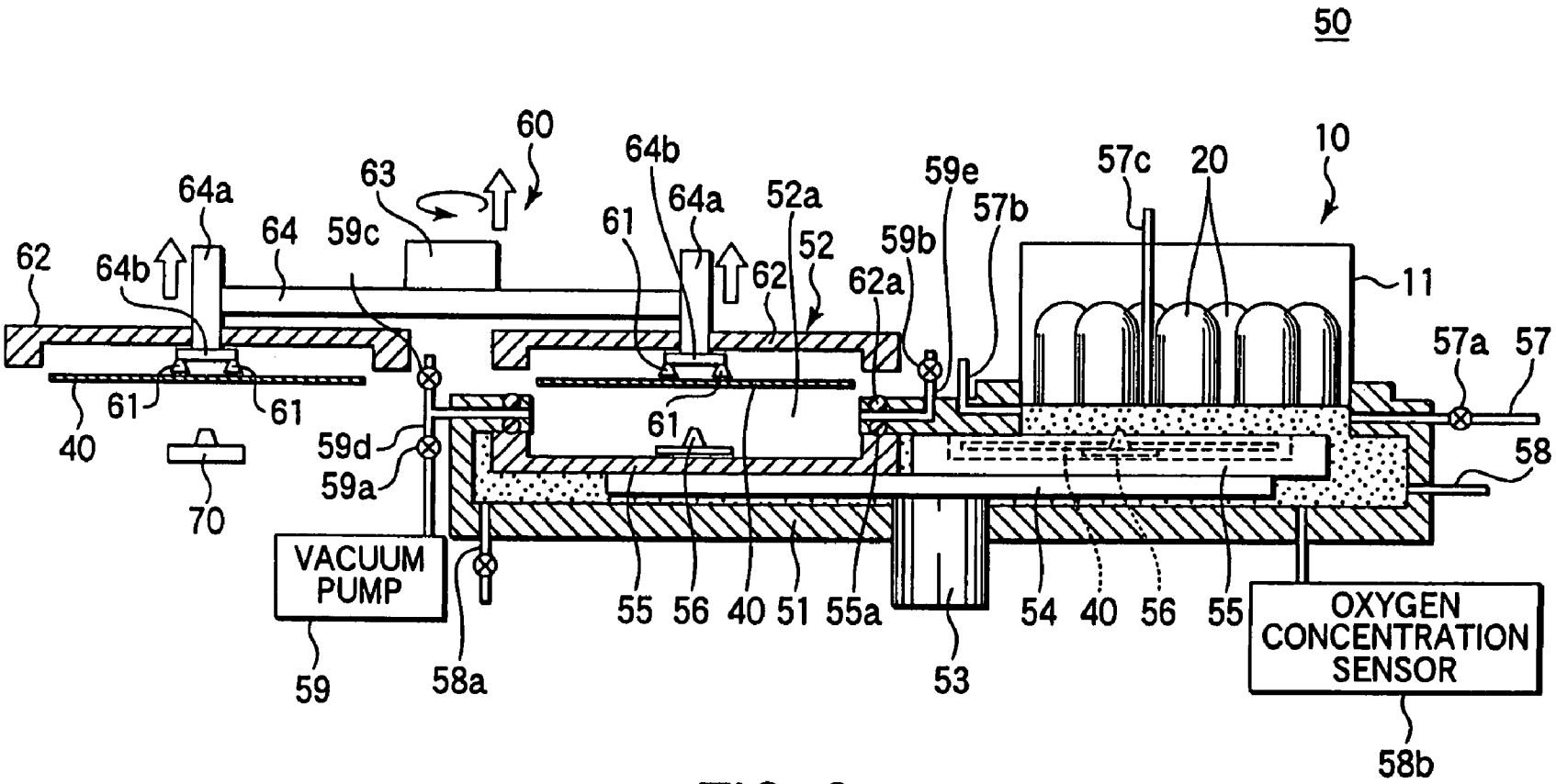
Figure 7:
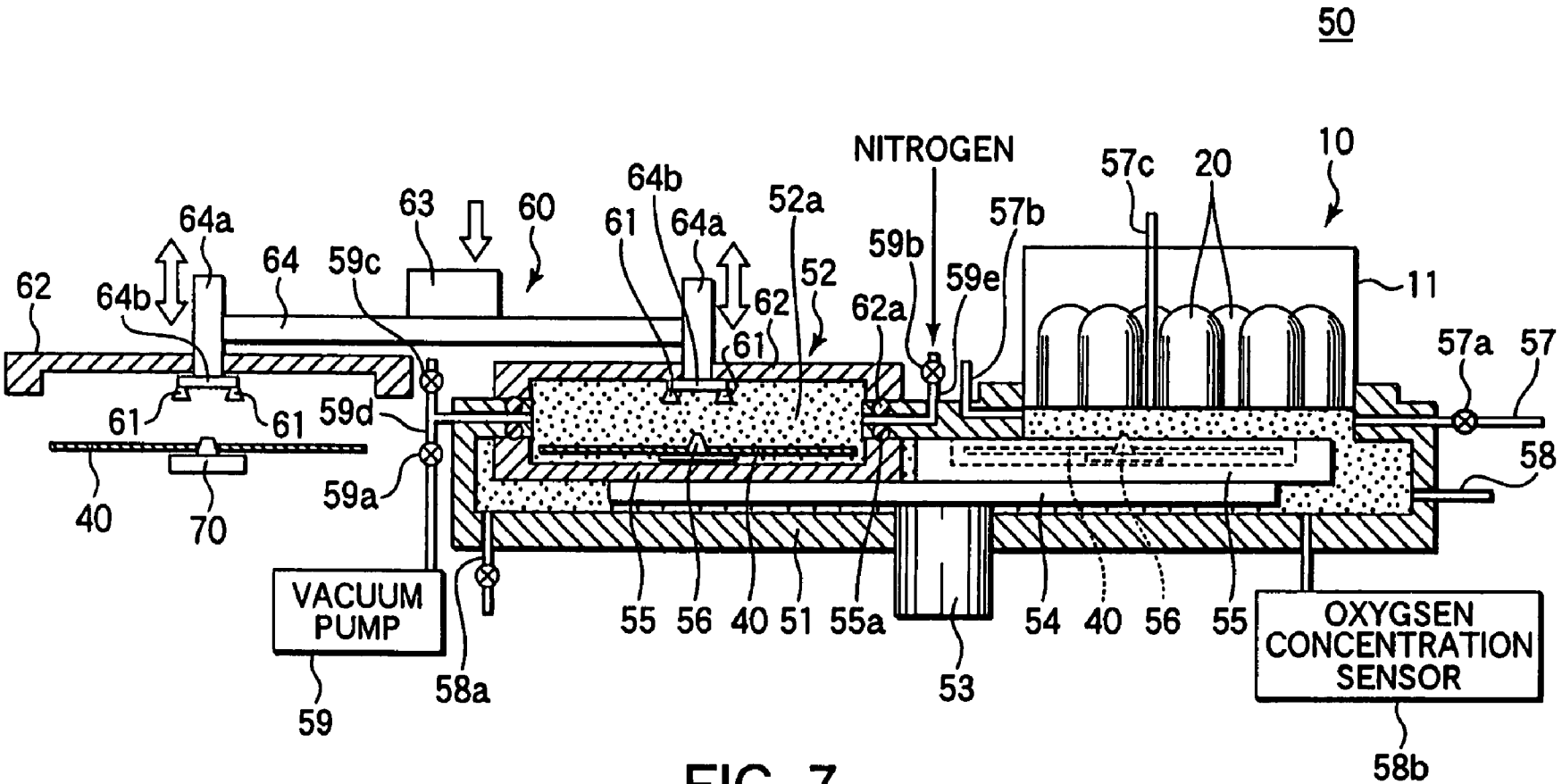

Thereafter, as shown in FIG. 6, the holding arms 64*a* are moved up, and the outer transfer turn shaft 63 of the outer transfer arm 64 is turned by 180 degrees, so that the positions of the irradiated irradiation target 40 and the non-irradiated irradiation target 40 are switched to each other. Then, as shown in FIG. 7, the outer transfer turn trays 62 supported by the outer transfer arm 64 are moved down, so that the non-irradiated irradiation target 40 is delivered to the inner transfer turn tray 55, and the irradiated irradiation target 40 is delivered to the irradiation target delivery portion 70. Also, the replacement room section 52 is formed in an airtightly closed state by the inner transfer turn tray 55 and outer transfer turn tray 62.

Then, while the displacement gas supply control valve 59*b* and atmosphere ventilation valve 59*c* are closed, the exhaust control valve 59*a* is opened, and the interior of the replacement room section 52 is vacuum-exhausted by the vacuum pump 59. Then, the exhaust control valve 59*a* is closed and the displacement gas supply control valve 59*b* is opened, an inert gas is supplied for a short period of time into the replacement room section 52 in a vacuum-exhausted state. By doing so, the interior of the replacement room section 52 is entirely displaced with a relatively small amount of inert gas in a short period of time.

Figure 8:
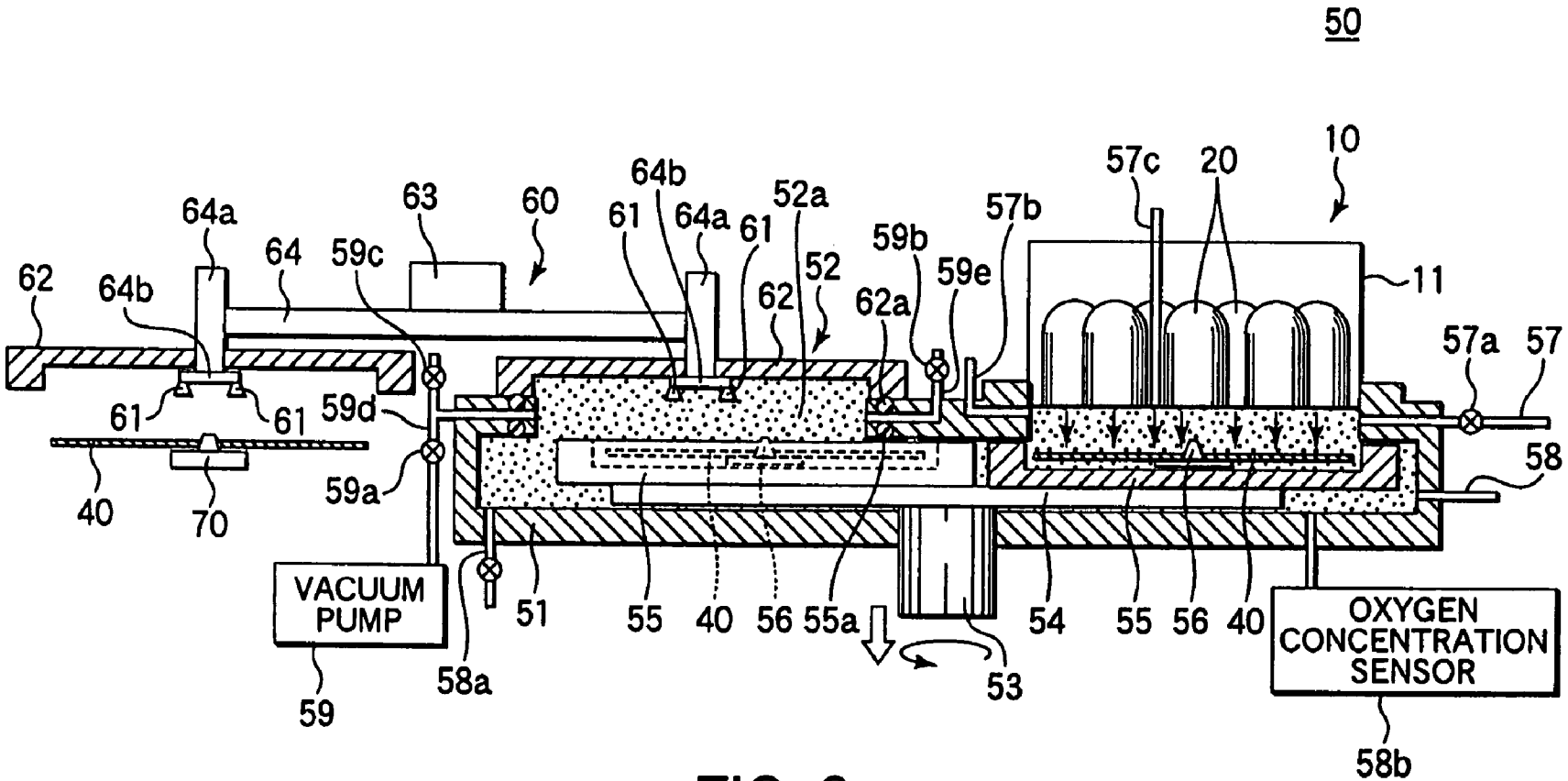

Thereafter, as shown in FIG. 8, the inner transfer turn trays 55 are moved down along with the revolution shaft 53, so that the close contact state of the corresponding inner transfer turn tray 55 is dissolved. Then, the revolution arm portion 54 is turned, so that another inner transfer turn tray 55 supporting an irradiated irradiation target 40 is positioned at the replacement room section 52.

As this time, as shown in FIG. 2, an irradiation target 40 mounted on one of the inner transfer turn trays 55 passes through the position directly below the electron beam irradiation section 10 by turning of the revolution arm portion 54. Accordingly, this irradiation target 40 is irradiated all over with electron beams emitted from vacuum-tube type irradiation tubes 20 arrayed in the width direction of the passage area 40*a*. During this time, an irradiated irradiation target 40 is replaced with a non-irradiated irradiation target 40, at the irradiation target delivery portion 70 outside the chamber 51.

Thereafter, from a state where one of the inner transfer turn trays 55 supporting an irradiated irradiation target 40 is positioned directly below the opening 52*a*, the revolution shaft 53 is moved up, so that the inner transfer turn tray 55 comes into close contact with the shielding seal portion 55*a*. By doing so, the replacement room section 52 is formed in an airtightly closed state, as shown in FIG. 1.

As described above, according to this embodiment, one of the inner transfer turn trays 55 disposed inside the chamber 51, and one of the outer transfer turn trays 62 of the irradiation target transfer device 60 disposed outside the chamber 51 constitute the replacement room section 52 having a load-lock function. With this arrangement, replacement of irradiation targets 40 can be performed, without damaging the inert gas atmosphere in the chamber 51, while preventing leakage of X-rays generated from the electron beam irradiation section 10. As a consequence, it is possible to reduce the amount of consumption of inert gas, which is used for maintaining the interior of the chamber 51 at a low oxygen concentration. Further, there is no need to separately prepare a special load-lock chamber or large-sized shield chamber made of lead, thereby allowing the apparatus to be compact.

The flow rate of an inert gas used for cooling the vacuum-tube type irradiation tubes 20 of the electron beam irradiation section 10 is controlled by feedback control in accordance with the temperature measurement result detected by the temperature sensor 57*c* at the radiation windows 25 of the vacuum-tube type irradiation tubes 20. As a consequence, the amount of consumption of inert gas is suppressed to a minimum amount required for this purpose, i.e., the amount of consumption is further reduced.

The position of the electron beam irradiation section 10 is set to be intermediate between the stop positions of the inner transfer turn trays 55, so that electron beam irradiation at the electron beam irradiation section 10 is performed on an irradiation target 40, while the inner transfer turn trays 55 are moved for replacement of irradiation targets 40. This arrangement makes it possible to remove the time necessary for a stop and irradiation operation for electron beam irradiation, thereby realizing a shorter cycle time, as compared to a case where electron beam irradiation is performed on an irradiation target 40 while an inner transfer turn tray 55 supporting the target is stopped.

When the inner transfer turn trays 55 are stopped, irradiation targets 40 are positioned out of the electron beam irradiation section 10. This allows the dose amount to be uniform among a plurality of irradiation targets 40.

The vacuum-tube type irradiation tubes 20 are used which are arrayed across the passage area 40*a* for an irradiation target 40 transferred by revolution of the inner transfer turn trays 55, which is caused by turning of the revolution arm portion 54. The irradiation dose of the vacuum-tube type irradiation tubes 20 is set to be gradually higher as their positions are shifted from the inner side to the outer side of the passage area 40*a*. Therefore, the imbalance dose amount caused by the difference of the passage speeds of the respective portions of an irradiation target 40 relative to the electron beam 10 created during revolution is canceled, and the dose amount can be uniform all over the irradiation target 40.

Figure 9:
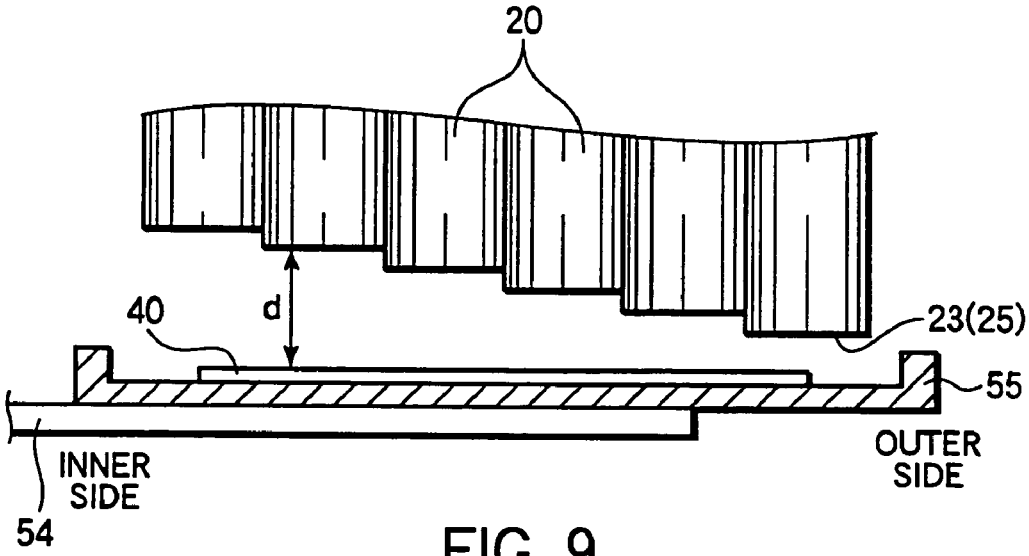
FIG. 9 is a sectional view showing the electron beam irradiation section of an electron beam irradiation apparatus according to another embodiment of the present invention.

An arrangement shown in FIG. 9 may be adopted to adjust the imbalance in dose amount caused by different passage speeds, relative to the electron beam irradiation section 10, among the respective portions of an irradiation target 40. Specifically, the intensity of an electron beam emitted from the radiation window 25 of a vacuum-tube type irradiation tube 20 is in reverse proportion to the distance d from the irradiation target 40. In view of this, the height of the respective vacuum-tube type irradiation tubes 20 from the inner transfer turn tray 55 is set to gradually reduce the distance d as their positions are shifted from the inner side to the outer side of the passage area 40*a*. In this case, the distance d is larger on the inner side where the amount of electron beam irradiation needs to be smaller, while the distance d is smaller on the outer side.

With this arrangement, although the respective portions of an irradiation target 40 have different passage speeds relative to the electron beam irradiation section 10, the imbalance in dose amount caused by the passage speeds is offset, and the dose amount can be uniform all over the irradiation target 40.

Figure 10:
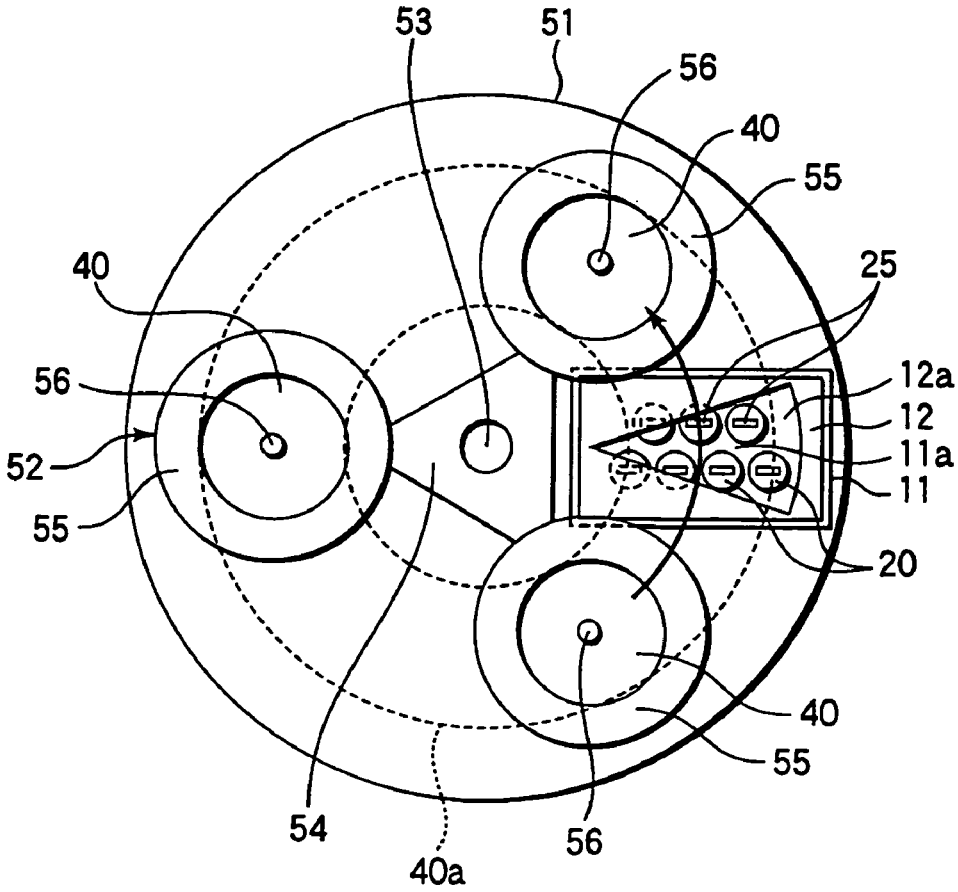
FIG. 10 is a plan view showing an electron beam irradiation apparatus according to still another embodiment of the present invention.

As still another arrangement, the electron beam irradiation section 10 may be provided with a mask 12, as illustrated in FIG. 10.

This mask 12 is disposed between the vacuum-tube type irradiation tubes 20 and irradiation target 40, and has an opening 12*a* with an open width gradually increased from the inner side to the outer side. In this case, when an irradiation target 40 is moved along the passage area 40*a* by revolution, the inner side thereof having a smaller peripheral velocity is exposed to electron beams emitted from the vacuum-tube type irradiation tubes 20 for a shorter period of time, as compared to the outer side having a larger peripheral velocity. As a consequence, the electron beam dose amount can be uniform all over the irradiation target 40.

Figure 11:
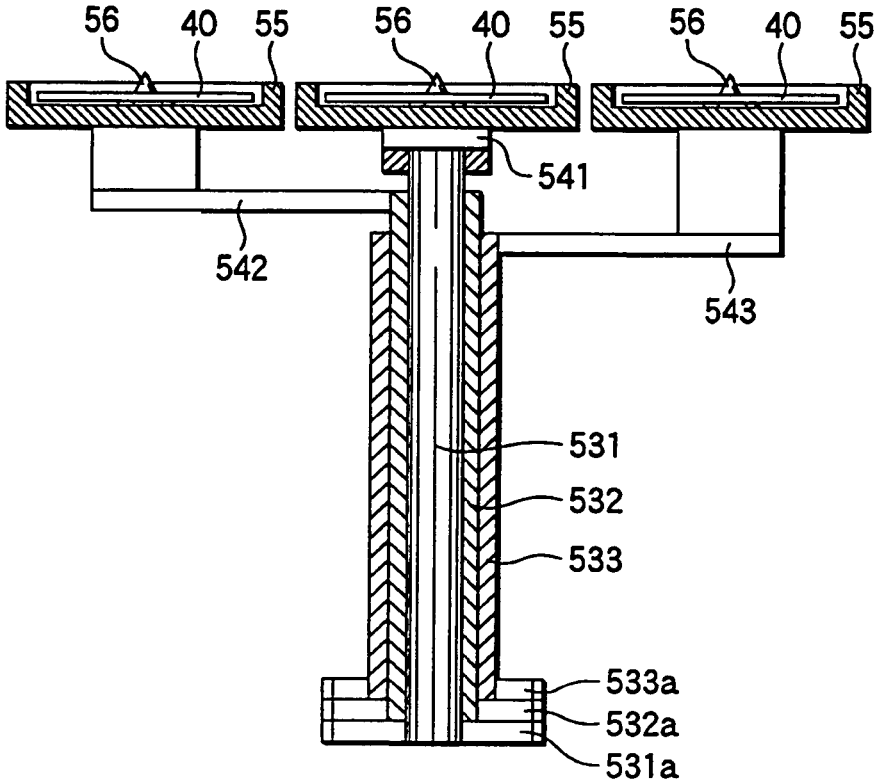
FIG. 11 is a sectional view showing an inner transfer turn tray and a drive portion thereof used in an electron beam irradiation apparatus according to still another embodiment of the present invention.

FIG. 11 shows a modification in relation to the revolution shaft 53 and revolution arm portion 54 according to the embodiment. In the modification shown in FIG. 11, a plurality of inner transfer turn trays 55 can be turn-transferred and moved up and down independently of each other.

Specifically, in this case, the revolution shaft 53 comprises a revolution shaft 531, a revolution shaft 532, and a revolution shaft 533, which are concentrically superposed and can be turned independently of each other. These shafts are driven by a pulley 531*a*, a pulley 532*a*, and a pulley 533*a* for rotation, respectively, and are independently moved up and down by an elevator mechanism (not shown). The revolution arm portion 54 comprises a revolution arm portion 541, a revolution arm portion 542, and a revolution arm portion 543, which are independent of each other and connected to the revolution shafts 531 to 533, respectively. These revolution arm portions 541 to 543 respectively support the inner transfer turn trays 55.

With this arrangement, each of the inner transfer turn trays 55 can transfer an irradiation target 40 within the chamber 51, independently of the others. For example, there is a case where some restriction is imposed on the speed of an inner transfer turn tray 55 passing through the electron beam irradiation section 10 to control the electron beam irradiation amount at the electron beam irradiation section 10. Even in such a case, the movement speeds of the inner transfer turn trays 55 from the replacement room section 52 to the electron beam irradiation section 10 and from the electron beam irradiation section 10 to the replacement room section 52 can be set without reference to this restriction. As a consequence, it is possible to shorten the total cycle time including replacement of irradiation targets 40 and electron beam irradiation.

Specifically, even where the passage time at the electron beam irradiation section 10 needs to be prolonged, the movement speeds from the replacement room section 52 to the irradiation start position in the electron beam irradiation section 10 and from the irradiation end position to the replacement room section 52 can be set higher, thereby shortening the time necessary for transfer movement.

The embodiments described above are intended only to clarify the technical content of the present invention, and thus the present invention should not be construed as being limited only to those specific examples. The embodiment described above may be modified and implemented in various ways within the spirit of the present invention and the scope of the claims.

For example, the embodiments described above employs vacuum-tube type irradiation tubes, as an example, but may employ a conventional drum type irradiation tube. Further, if an arrangement is adopted such that an acceleration voltage is applied to the electron beam irradiation section only when a ceiling plate and an irradiation target worktable engage with each other for electron beam irradiation, the peripheral devices thereof can be simplified. This arrangement, however, makes the cycle time longer, and thus should be adopted, depending on the purpose.

In the embodiments described above, the irradiation target is exemplified by a disk-like object, but it is not limited thereto. Further, electron beam irradiation may be utilized for sterilization other than cross-linking or curing of a resin.

It should be noted that the present invention includes various modifications made by suitably combining some of the components of the embodiments described above or removing a part of the components, as long as they do not depart from the scope of the present invention.

What is claimed is:

1. An electron beam irradiation apparatus comprising:

a turn-transfer mechanism which turn-transfers an irradiation target;

a turn irradiation chamber in which the turn-transfer mechanism is disposed;

an electron beam irradiation section which is located in said turn irradiation chamber, and which irradiates the irradiation target with an electron beam during turn-transfer of the irradiation target while shifting stop positions;

a replacement room which is disposed at a part of the turn irradiation chamber, and which brings the irradiation target into and out of the turn irradiation chamber;

an outer irradiation target turn tray which: (i) is disposed outside the turn irradiation chamber, (ii) forms a part of the replacement room, and (iii) includes an X-ray shielding mechanism, an airtightness maintaining mechanism, and an irradiation target holding mechanism;

an inner irradiation target turn tray which: (i) is disposed inside the turn irradiation chamber, (ii) forms a part of the replacement room, (iii) includes an X-ray shielding mechanism, an airtightness maintaining mechanism, and an irradiation target holding mechanism, and (iv) is supported by the turn-transfer mechanism;

a turning mechanism which drives the turn-transfer mechanism in a transfer direction; and an elevator mechanism which moves the turn-transfer mechanism up and down.

2. The electron beam irradiation apparatus according to claim 1, wherein the electron beam irradiation section includes a plurality of vacuum-tube type irradiation tubes, and is provided with a dose adjustment mechanism which attains a uniform absorption dose over the irradiation target, in accordance with peripheral velocities of the irradiation target during revolution, wherein the irradiation target is mounted on the inner irradiation target turn tray supported by the turn-transfer mechanism.

3. The electron beam irradiation apparatus according to claim 2, wherein the dose adjustment mechanism comprises a function to adjust a tube current of each of the vacuum-tube type irradiation tubes, in accordance with peripheral velocities of the irradiation target during revolution, wherein the irradiation target is mounted on the inner irradiation target turn tray.

4. The electron beam irradiation apparatus according to claim 2, wherein the dose adjustment mechanism comprises a function to adjust a distance between the inner irradiation target turn tray and an irradiation window of the electron beam irradiation section, in accordance with peripheral velocities of the irradiation target during revolution, wherein the irradiation target is mounted on the inner irradiation target turn tray.

5. The electron beam irradiation apparatus according to claim 2, wherein the dose adjustment mechanism comprises a mask which is disposed between an irradiation window of the electron beam irradiation section and the irradiation target that is mounted on the inner irradiation target turn tray, wherein an opening degree of the mask varies in accordance with peripheral velocities of the mounted irradiation target during revolution.

6. The electron beam irradiation apparatus according to claim 1, further comprising a plurality of inner irradiation target turn trays disposed substantially equidistantly in a turn-transfer direction, such that, when one of the inner irradiation target turn trays is positioned at the replacement room, the electron beam irradiation section is positioned between two adjacent inner irradiation target turn trays.

7. The electron beam irradiation apparatus according to claim 6, wherein the turn-transfer mechanism comprises a function to turn the inner irradiation target turn trays in the transfer direction, independently of each other.

8. The electron beam irradiation apparatus according to claim 1, further comprising a first inert gas inlet and an inert gas outlet which form a flow of an inert gas near an irradiation window of the electron beam irradiation section.

9. The electron beam irradiation apparatus according to claim 8, further comprising:

a temperature sensor disposed near the irradiation window, and a temperature control mechanism which adjusts a flow rate of the inert gas, in accordance with temperature measured by the temperature sensor, so as to control temperature of the irradiation window.

10. The electron beam irradiation apparatus according to claim 1, further comprising a vacuum displacement mechanism which supplies an inert gas into the replacement room after or while pressure-reducing the replacement room, which is kept airtight, so as to displace an interior of the replacement room with the inert gas.

11. The electron beam irradiation apparatus according to claim 1, further comprising a second inert gas inlet which fills the turn irradiation chamber with an inert gas.

12. The electron beam irradiation apparatus according to claim 11, further comprising:

an oxygen concentration sensor disposed in the turn irradiation chamber, and an oxygen concentration control mechanism which adjusts a flow rate of the inert gas supplied from the second inert gas inlet into the turn irradiation chamber, in accordance with oxygen concentration measured by the oxygen concentration sensor.

13. An electron beam irradiation method for irradiating an irradiation target with an electron beam under an inert gas atmosphere while turn-transferring the irradiation target within a turn irradiation chamber, using an electron beam irradiation apparatus which comprises: a turn-transfer mechanism which turn-transfers the irradiation target; the turn irradiation chamber in which the turn-transfer mechanism is disposed; an electron beam irradiation section which is located in said turn irradiation chamber, and which irradiates the irradiation target with the electron beam during turn-transfer of the irradiation target while shifting stop positions; a replacement room which is disposed at a part of the turn irradiation chamber, and which brings the irradiation target into and out of the turn irradiation chamber; an outer irradiation target turn tray which: (i) is disposed outside the turn irradiation chamber, (ii) forms a part of the replacement room, and (iii) includes an X-ray shielding mechanism, an airtightness maintaining mechanism, and an irradiation target holding mechanism; and an inner irradiation target turn tray which: (i) is disposed inside the turn irradiation chamber, (ii) forms a part of the replacement room, (iii) includes an X-ray shielding mechanism, an airtightness maintaining mechanism, and an irradiation target holding mechanism, and (iv) is supported by the turn-transfer mechanism, the method comprising:

transferring the irradiation target between the inner irradiation target turn tray and the outer irradiation target turn tray to bring the irradiation target into and out of the turn irradiation chamber;

driving the inner irradiation target turn tray for moving up and down and for turn-transferring, by the turn-transfer mechanism, the irradiation target; and irradiating the irradiation target with the electron beam while the inner irradiation target turn tray passes through the electron beam irradiation section during the turn-transfer.

14. The electron beam irradiation method according to claim 13, wherein the electron beam irradiation section includes a plurality of vacuum-tube type irradiation tubes which irradiate the irradiation target with electron beams, and wherein an irradiation dose distribution is adjusted to attain a uniform absorption dose over the irradiation target, in accordance with peripheral velocities of the irradiation target during the turn-transfer.

15. The electron beam irradiation method according to claim 14, wherein the irradiation dose distribution is adjusted by changing a tube current of each of the vacuum-tube type irradiation tubes, in accordance with peripheral velocities of the irradiation target during the turn-transfer.

16. The electron beam irradiation method according to claim 14, wherein the irradiation dose distribution is adjusted by changing a distance between the inner irradiation target turn tray and an irradiation window of the electron beam irradiation section, in accordance with peripheral velocities of the irradiation target during the turn-transfer.

17. The electron beam irradiation method according to claim 14, wherein the dose is adjusted by disposing a mask between an irradiation window of the electron beam irradiation section and the irradiation target, wherein an opening degree of the mask varies in accordance with peripheral velocities of the irradiation target during the turn-transfer.

18. The electron beam irradiation method according to claim 13, wherein a plurality of inner irradiation target turn trays are disposed such that, when one of the inner irradiation target turn trays is positioned at the replacement room, each of the other inner irradiation target turn trays are positioned out of an irradiation part of the electron beam irradiation section.

19. The electron beam irradiation method according to claim 18, wherein the inner irradiation target turn trays are supplied with turn-transfer movement independently of each other by the turn-transfer mechanism, such that, while one of the inner irradiation target turn trays is used to bring an irradiation target into and out of the replacement room, another one of the inner irradiation target turn trays that holds another irradiation target is turned to pass through the electron beam irradiation section, thereby irradiating said another irradiation target with the electron beam.

20. The electron beam irradiation method according to claim 13, wherein the turn irradiation chamber is filled with an inert gas to reduce residual oxygen concentration, when the irradiation target is irradiated with the electron beam.

21. The electron beam irradiation method according to claim 13, wherein an inert gas is supplied into the replacement room after or while pressure-reducing the replacement room, so as to displace an interior of the replacement room with the inert gas.

22. The electron beam irradiation method according to claim 13, wherein a flow rate of the inert gas is adjusted, in accordance with oxygen concentration measured by an oxygen concentration sensor disposed in the turn irradiation chamber, so as to control oxygen concentration in the turn irradiation chamber.

23. The electron beam irradiation method according to claim 13, wherein a flow rate of an inert gas supplied near an irradiation window of the electron beam irradiation section is adjusted, in accordance with temperature measured by a temperature sensor disposed near the irradiation window, so as to control temperature of the irradiation window.

* * * * *